US009586417B2

(12) United States Patent
Chida

(10) Patent No.: US 9,586,417 B2
(45) Date of Patent: Mar. 7, 2017

(54) SHEET FEEDING DEVICE AND PRINT DEVICE

(71) Applicant: Oki Data Corporation, Tokyo (JP)

(72) Inventor: Toshiyuki Chida, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/675,919

(22) Filed: Apr. 1, 2015

(65) Prior Publication Data

US 2015/0273888 A1 Oct. 1, 2015

(30) Foreign Application Priority Data

Apr. 1, 2014 (JP) ..... 2014-075437

(51) Int. Cl.

| | |
|---|---|
| ***B41J 29/38*** | (2006.01) |
| ***B41J 2/01*** | (2006.01) |
| ***B41J 11/00*** | (2006.01) |
| ***B41J 11/66*** | (2006.01) |
| ***B41J 15/04*** | (2006.01) |
| ***B65H 35/06*** | (2006.01) |
| ***B65H 26/06*** | (2006.01) |

(52) U.S. Cl.

CPC ..... *B41J 11/0095* (2013.01); *B41J 11/663* (2013.01); *B41J 15/04* (2013.01); *B65H 26/063* (2013.01); *B65H 35/06* (2013.01); *B65H 2301/5151* (2013.01); *B65H 2301/5152* (2013.01); *B65H 2511/11* (2013.01); *B65H 2801/06* (2013.01)

(58) Field of Classification Search

CPC ..... B65H 35/04; B65H 16/00; B65H 16/005; B41J 11/0095; B41J 13/0009; B41J 29/38; B41J 13/0027; B41J 13/103; B41J 29/393; B41J 11/003; B41J 11/70; B41J 11/663

USPC ..... 347/16, 19, 101, 104; 271/265.01; 242/562, 563

See application file for complete search history.

(56) References Cited

U.S. PATENT DOCUMENTS

2013/0057930 A1* 3/2013 Toki ..... B65H 35/04 358/488
2014/0043387 A1* 2/2014 Maeda ..... B41J 13/0009 347/16

FOREIGN PATENT DOCUMENTS

JP 08216465 A * 8/1996
JP H08216465 A 8/1996

* cited by examiner

*Primary Examiner* — Jannelle M Lebron
(74) *Attorney, Agent, or Firm* — Muncy, Geissler, Olds & Lowe, P.C.

(57) ABSTRACT

A sheet feeding device that performs sheet feeding by feeding out and cutting a continuous medium includes a carrying part that carries the medium, a detection part that detects a leading edge of the medium and a length over which the medium has been carried, a trailing edge detection part that detects a trailing edge of the medium specified by a user; and a cutting part arranged between the detection part and the trailing edge detection part, and is capable of cutting the medium or forming cuts in the medium (a perforation process). When a minimum length of the medium that is carried by the carrying part is L2, a length from the detection part to the trailing edge detection part is L3, and a length of the medium that is specified by the user is L4, when the trailing edge of the medium is detected, and when L4<L3<L2+L4 is satisfied, the detection part detects a position is L4, and the cutting part forms cuts in the medium at the position.

6 Claims, 12 Drawing Sheets

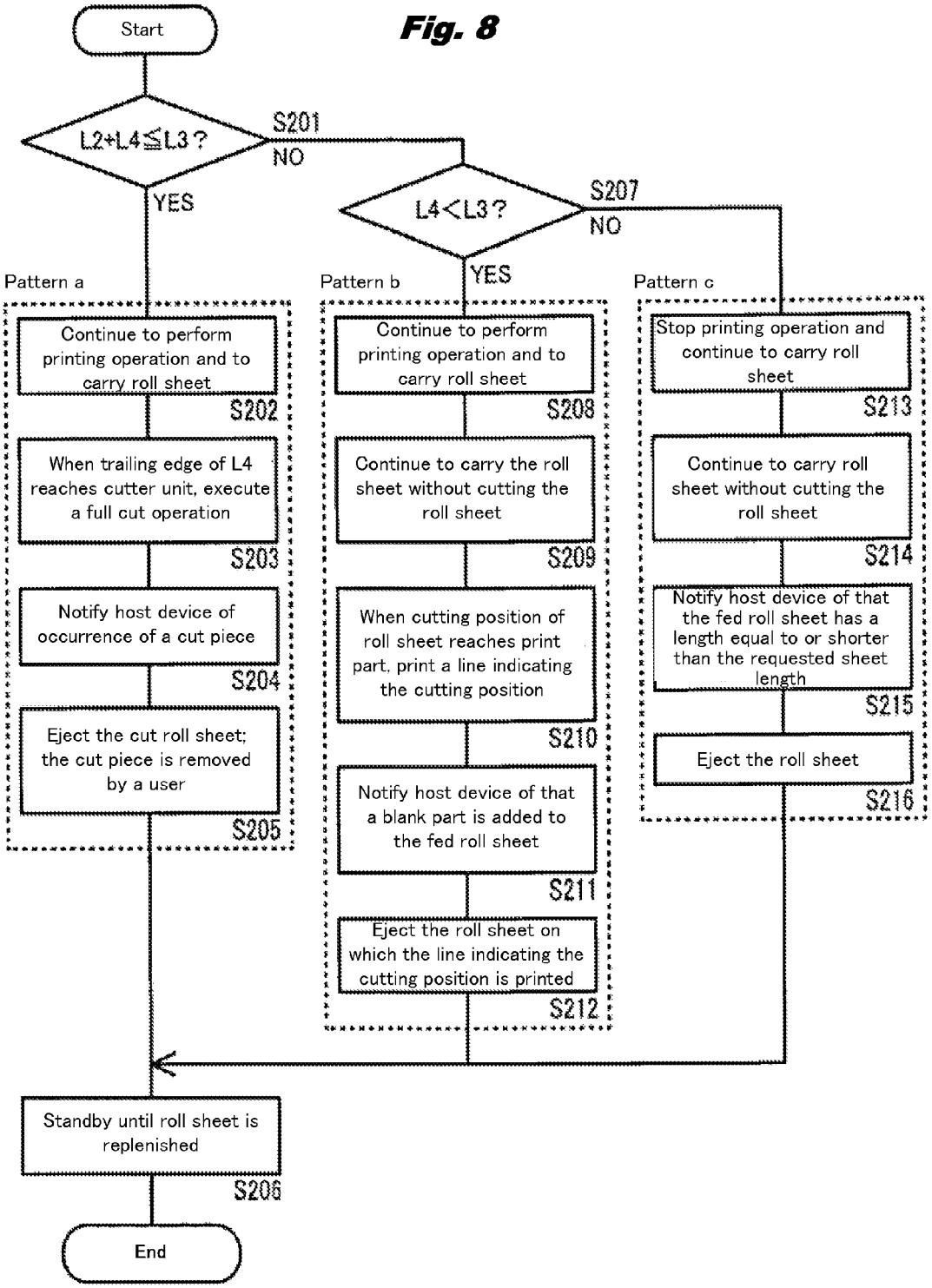
Fig. 8
Start
L2+L4≦L3?
S201
NO
YES
L4<L3?
S207
NO
YES
Pattern a
Continue to perform printing operation and to carry roll sheet
S202
When trailing edge of L4 reaches cutter unit, execute a full cut operation
S203
Notify host device of occurrence of a cut piece
S204
Eject the cut roll sheet; the cut piece is removed by a user
S205
Pattern b
Continue to perform printing operation and to carry roll sheet
S208
Continue to carry the roll sheet without cutting the roll sheet
S209
When cutting position of roll sheet reaches print part, print a line indicating the cutting position
S210
Notify host device of that a blank part is added to the fed roll sheet
S211
Eject the roll sheet on which the line indicating the cutting position is printed
S212
Pattern c
Stop printing operation and continue to carry roll sheet
S213
Continue to carry roll sheet without cutting the roll sheet
S214
Notify host device of that the fed roll sheet has a length equal to or shorter than the requested sheet length
S215
Eject the roll sheet
S216
Standby until roll sheet is replenished
S206
End

SHEET FEEDING DEVICE AND PRINT DEVICE

CROSS REFERENCE

The present application is related to, claims priority from and incorporates by reference Japanese Patent Application No. 2014-075437, filed on Apr. 1, 2014.

TECHNICAL FIELD

The present invention relates to a sheet feeding device that performs sheet feeding by cutting a roll sheet, and to a print device that includes the sheet feeding device.

BACKGROUND

A conventional print device is provided with a sheet feeding device that performs sheet feeding by cutting a roll sheet (medium) to a length specified by a user, and prints on the roll sheet cut by the sheet feeding device. When a trailing edge of the roll sheet is detected, and when it is judged that, once the roll sheet is cut, a cut piece containing the trailing edge of the roll sheet cannot be carried, the sheet feeding device feeds the roll sheet as a blank part, without cutting the roll sheet, so as to avoid leaving the cut piece in the sheet feeding device to become a factor causing sheet jam (for example, see Patent Document 1).

Patent Document 1: Japanese Patent Laid-Open Publication No. H8-216465.

However, in the conventional technology, when the trailing edge of the roll sheet is detected, and when it is judged that, once the roll sheet is cut, the trailing edge of the roll sheet has a length that does allow the trailing edge of the roll sheet to be carried, by feeding the trailing edge of the roll sheet as a blank part without cutting the roll sheet to a length specified by a user, printing is performed on the roll sheet that does not have a length specified by the user. Therefore, there is a problem that, when the user removes the blank part from the printed roll sheet, an operation to measure a length using a ruler, a measuring tape or the like occurs. A purpose of the present invention is to solve the above-described problem and to allow the operation to measure the length of the blank part to be omitted when the user removed the blank part from the printed roll sheet.

A sheet feeding device, which is disclosed in the application, that performs sheet feeding by feeding out and cutting a continuous medium includes a carrying part that carries the medium, which means a carrying process; a detection part that detects a leading edge of the medium in a carrying direction and detects a length over which the medium has been carried from a detected position; a trailing edge detection part that is arranged on an upstream side of the detection part in the carrying direction of the medium and detects a trailing edge of the medium, the trailing edge being determined from the leading edge with a length specified by a user; and a cutting part that is arranged between the detection part and the trailing edge detection part, and is capable of cutting the medium, which means a cutting process, or forming cuts in the medium, which means a perforation process. When a minimum length of the medium that is carried by the carrying part is L2, a length from the detection part to the trailing edge detection part is L3, and a length of the medium that is specified by the user is L4, when the trailing edge detection part detects the trailing edge of the medium, and when L4<L3<L2+L4 is satisfied, the detection part detects a position at which a length of the medium from the leading edge is L4, and the cutting part forms cuts in the medium at the position that is detected by the detection part and at which the length of the medium from the leading edge is L4.

According to the present invention, an effect is obtained that, when the user removes the blank part from the printed roll sheet, the operation to measure the length of the blank part can be omitted.

BRIEF DESCRIPTION OF DRAWINGS

FIG. 8 is a flow diagram illustrating flow of a sheet feeding process at a trailing edge of a roll sheet in the second embodiment.

DETAILED EMBODIMENTS

In the following, with reference to the drawings, embodiments of a sheet feeding device and a print device according to the present invention are described.

First Embodiment

Figure 1:
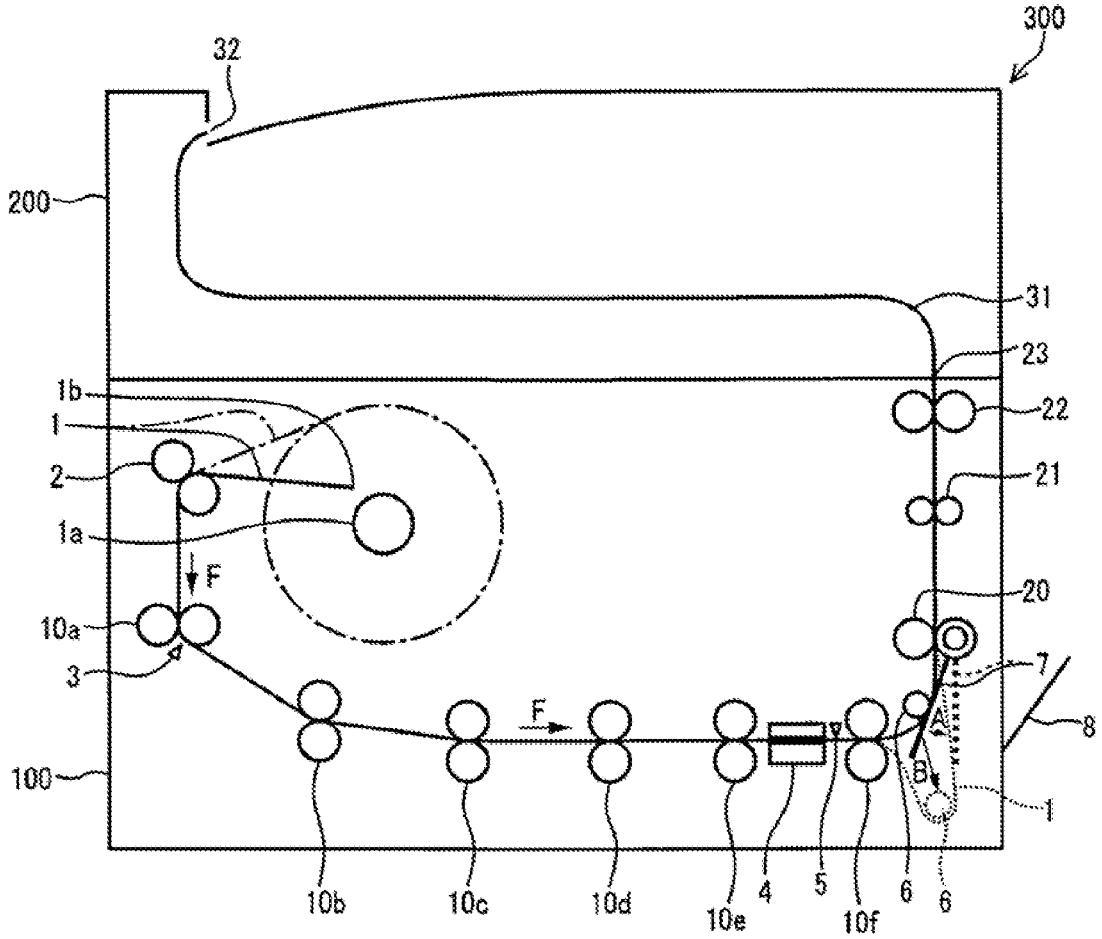
FIG. 1 is a schematic side view illustrating a configuration of a print device an embodiment. The print device includes a roll sheet feeding part, a printing part and other parts.

FIG. 1 illustrates a configuration of the print device having a roll sheet feeding part and a printing part according to an embodiment. In FIG. 1, a print device 300 is a printer that generates image data according to print data transmitted from a host device such as a host computer that is connected via a communication line, and performs printing based on the image data. The print device 300 is configured by a roll sheet feeding part 100 and a printing part 200. Additionally, FIG. 1 is to be used for explanations for all of the other embodiments. The roll sheet feeding part 100 as a sheet feeding device feeds out a roll sheet 1 based on a sheet feeding instruction and sheet length data that are transmitted along with the print data from the host device, cuts the roll sheet 1 into a length (requested sheet length) specified by a user and feeds the cut roll sheet 1 to the printing part 200. Further, in a case where a trailing edge 1*b* of the roll sheet 1 is detected, when a "predetermined condition" (to be described later) is satisfied, the roll sheet feeding part 100 forms a perforation in the roll sheet 1 at a position corresponding to the requested sheet length and feeds the roll sheet 1 to the printing part 200. FIG. 1 illustrates a state in which the trailing edge 1*b* of the roll sheet 1 is separated from a roll sheet tube 1*a* that is a winding core of the roll sheet 1. Further, the roll sheet 1 illustrated using a one-dotted chain line in FIG. 1 is for reference, and illustrates a state in which the roll sheet 1 is newly replenished in the roll sheet feeding part 100.

The roll sheet feeding part 100 is configured by a sheet end sensor 3, a cutter unit 4, a sheet length sensor 5, a cut slack bar 6, a cut slack guide 7, carrying roller pairs 2, 10*a*-10*f*, 20-22 as a carrying part, and an ejection port 23. The carrying roller pair 2 is arranged on a downstream side of the roll sheet 1 in a carrying direction indicated by an arrow F in FIG. 1 and carries the roll sheet 1 in the carrying direction. The carrying roller pairs 10*a*-10*f* are arranged on a downstream side of the carrying roller pair 2 in the carrying direction indicated by the arrow F in FIG. 1, and carries the roll sheet 1 in the carrying direction. The carrying roller parts are driven by carrying motors 109. The control is performed by the motor controller 108.

The sheet end sensor 3 as a trailing edge detection part is arranged on a downstream side of the carrying roller pair 10*a* in the carrying direction indicated by the arrow F in FIG. 1, and detects the trailing edge 1*b* of the roll sheet 1 in the carrying direction. The cutter unit 4 as a cutting part is arranged between the sheet length sensor 5 and the sheet end sensor 3, and cuts the roll sheet 1 carried by the carrying roller pairs into the requested sheet length or forms a perforation in the roll sheet 1. The cutter unit 4 has a full cutter part 11 and a perforation cutter part 12 that are illustrated in FIGS. 2, 3A and 3B.

Figure 2:
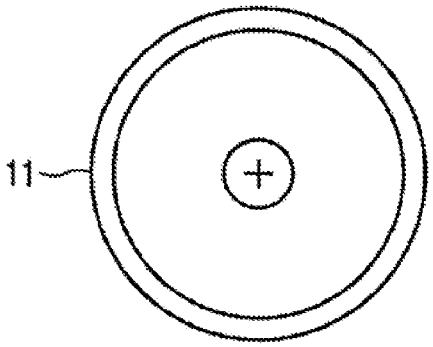
FIG. 2 is a side view illustrating a shape of a cutter having a full cutter part in the first embodiment.

As illustrated in FIG. 2, the full cutter part 11 is formed in a circular shape having a blade on an outer periphery thereof for cutting the roll sheet 1. Under the control of a cutter controller 107 (to be described later), the full cutter part 11 moves in a width direction of the roll sheet 1 illustrated in FIG. 1 (a direction orthogonal to the carrying direction of the roll sheet 1), and cuts the roll sheet 1. In the present embodiment, a case is described where the full cutter part cuts the roll sheet 1 while rotating. However, the present invention is not limited to this. It is also possible that the full cutter part cuts the roll sheet 1 in a vertical direction.

Figure 3A:
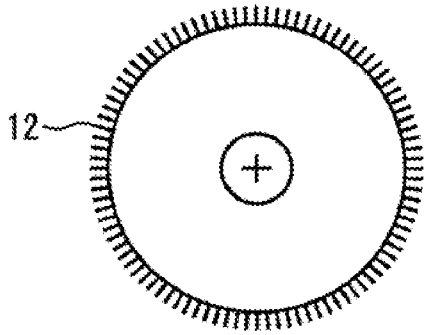
FIGS. 3A and 3B are side views illustrating a shape of a cutter having a perforation cutter part in the first embodiment.
Figure 3B:
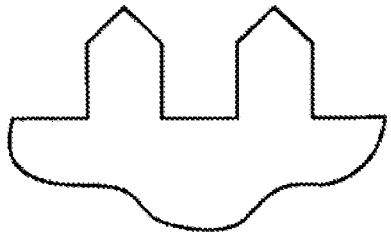

Further, as illustrated in FIGS. 3A and 3B, the perforation cutter part 12 is formed in a circular shape having fine blades provided at constant intervals on an outer periphery. When the "predetermined condition" (to be described later) is satisfied, under the control of the cutter controller 107, the perforation cutter part 12 rotates to scan in the width direction of the roll sheet 1 and forms a perforation in the roll sheet 1. FIGS. 3A and 3B illustrate side views illustrating a shape of a cutter that the perforation cutter part of the first embodiment has. FIG. 3A illustrates a side view of the perforation cutter part 12. FIG. 3B illustrates an enlarged portion of the outer periphery of the perforation cutter part 12. Further, "perforation" means an array of small cuts that are intermittently formed in the roll sheet 1 at a predetermined position so that the roll sheet 1 can be easily separated at the position.

The sheet length sensor 5 is arranged on a downstream side of the cutter unit 4 in the carrying direction indicated by the arrow F in FIG. 1, and detects a leading edge of the roll sheet 1 carried in the carrying direction indicated by the arrow F in FIG. 1 for obtaining a length (carrying distance) of roll sheet 1 roll sheet 1, the length starting from the leading edge. Further, the sheet length sensor 5 and a sheet length counter 106 (to be described later) together function as a detection part that detects the length of the roll sheet 1, and, when the leading edge of the roll sheet 1 is detected, detect the length (carrying distance) of the roll sheet 1 starting from the leading edge of the roll sheet 1. The cut slack bar 6 and the cut slack guide 7 are both arranged on a downstream side of the cutter unit 4 in the carrying direction indicated by the arrow F in FIG. 1, and allow the roll sheet 1 to have cut slack (to be described later) when the roll sheet 1 is cut or when a perforation is formed in the roll sheet 1.

The cut slack bar 6 is formed in a rod-like shape having a length equal to or longer than the width of the roll sheet 1, and assists in generation of cut slack in the roll sheet 1 as indicated by a dotted line in FIG. 1 by pressing down the cut slack guide 7, while in contact with the carried roll sheet 1, to ensure a route that allows the roll sheet 1 to be slackened, and moving in a direction indicated by an arrow B in FIG. 1 while in contact with the roll sheet 1. The cut slack guide 7 is for guiding the carried roll sheet 1 and is arranged rotatable toward a direction indicated by an arrow A in FIG. 1 so as not to interfere with the movement of the cut slack bar 6 in the direction indicated by the arrow B in FIG. 1.

Here, the cut slack in the present embodiment is described using a case where the roll sheet 1 is cut as an example. The cut slack is generally known. When the cutter unit 4 cuts the roll sheet 1, the carrying of the roll sheet 1 by the carrying roller pairs 10*e* and 10*f* that are respectively arranged on an upstream side and a downstream side of the cutter unit 4 in the carrying direction indicated by the arrow F in FIG. 1 is topped, and the roll sheet 1 is cut in a state of being stretched. In this case, a problem such as cut jamming is unlikely to occur and a state of a cut surface is good. However, when the carrying roller pairs 10*e* and 10*f* stop, feeding of the roll sheet 1 is stopped. Therefore, a throughput (sheet feeding capacity per unit time) of the roll sheet feeding part 100 is decreased.

Therefore, it is known that a carrying speed of the carrying roller pairs 2, 10*a*-10*f* is set to be faster than a carrying speed of the carrying roller pairs 20-22 to generate slack (cut slack) in the roll sheet 1. After the cut slack is generated, when the roll sheet 1 is carried and the sheet length sensor 5 detects a position corresponding to the requested sheet length, at least the carrying roller pairs 10*e* and 10*f* of the carrying roller pairs 2, 10*a*-10*f* are stopped and the roll sheet 1 is cut. In this case, the carrying roller pairs 20-22 continue to carry the roll sheet 1 and feeding of the roll sheet 1 to the printing part 200 is not stopped.

It is necessary that a length of the generated cut slack be a length that can ensure a time period allowing the full cutter part 11 or the perforation cutter part 12 to scan in a round-trip or in one way in the width direction of the roll sheet 1 to finish cutting the roll sheet 1. The cut slack in the present embodiment is not generated only by the change in the carrying speed of the carrying roller pair 20-22, but is generated while being assisted by the cut slack bar 6 and the cut slack guide 7.

A cover 8 is arranged openable and closable on a side surface of the roll sheet feeding part 100. The cover 8 can be opened by a user when a problem such as sheet jam occurs and allows a cut piece, which is a factor causing sheet jam and the like, to be removed from the inside of the roll sheet feeding part 100. The "cut piece" means a fragment containing the trailing edge 1*b* of the roll sheet 1 that is generated by the cutting of the roll sheet 1 by the cutter unit 4, and has a length in the carrying direction from a trailing edge of the requested sheet length to the trailing edge 1*b* of the roll sheet 1.

The carrying roller pairs 20-22 are arranged on a downstream side of the cut slack guide 7 in the carrying direction indicated by an arrow F in FIG. 1 and carry the roll sheet 1. The ejection port 23 is provided on an upper part of the roll sheet feeding part 100, and ejects the roll sheet 1 carried from the carrying roller pair 22 to the printing part 200. The printing part 200 as a printing part is arranged on a downstream side of the sheet length sensor 5 in the carrying direction indicated by the arrow F in FIG. 1, is fed by the roll sheet feeding part 100 with the roll sheet 1 cut into the requested sheet length, and performs printing on the roll sheet 1 using an electrophotographic method in which toner is used.

The printing part 200 performs printing while carrying the roll sheet 1 that has been cut along a carrying path 31, and ejects the roll sheet 1 from an ejection port 32. A case has been described where the printing part 200 performs printing using an electrophotographic method. However, without being limited to this, it is also possible to perform printing using an ink-jet method. The roll sheet 1 as a continuous medium is wound around the roll sheet tube 1*a* as a winding core, and is rotatably attached to a case (not illustrated in the drawings) of the roll sheet feeding part 100.

In the present embodiment, an example is described in which the trailing edge 1*b* of the roll sheet 1 in the carrying direction is not bonded to the roll sheet tube 1*a*. However, without being limited to this, even when the trailing edge 1*b* is glued to the roll sheet tube 1*a* or bonded to the roll sheet tube 1*a* using a simple tape, as long as this can be detected by the sheet end sensor 3, this can be applied. For example, in the case where the trailing edge 1*b* of the roll sheet 1 is glued on the roll sheet tube 1*a*, when a configuration is adopted in which tension of the roll sheet 1 is detected and the roll sheet 1 is cut on the upstream side of the sheet end sensor 3 in the carrying direction, this case can be applied. Further, in the case where the trailing edge 1*b* of the roll sheet 1 is bonded to the roll sheet tube 1*a* using a simple tape, when the tape can be peeled from the roll sheet tube 1*a*, this case can be applied.

Figure 4:
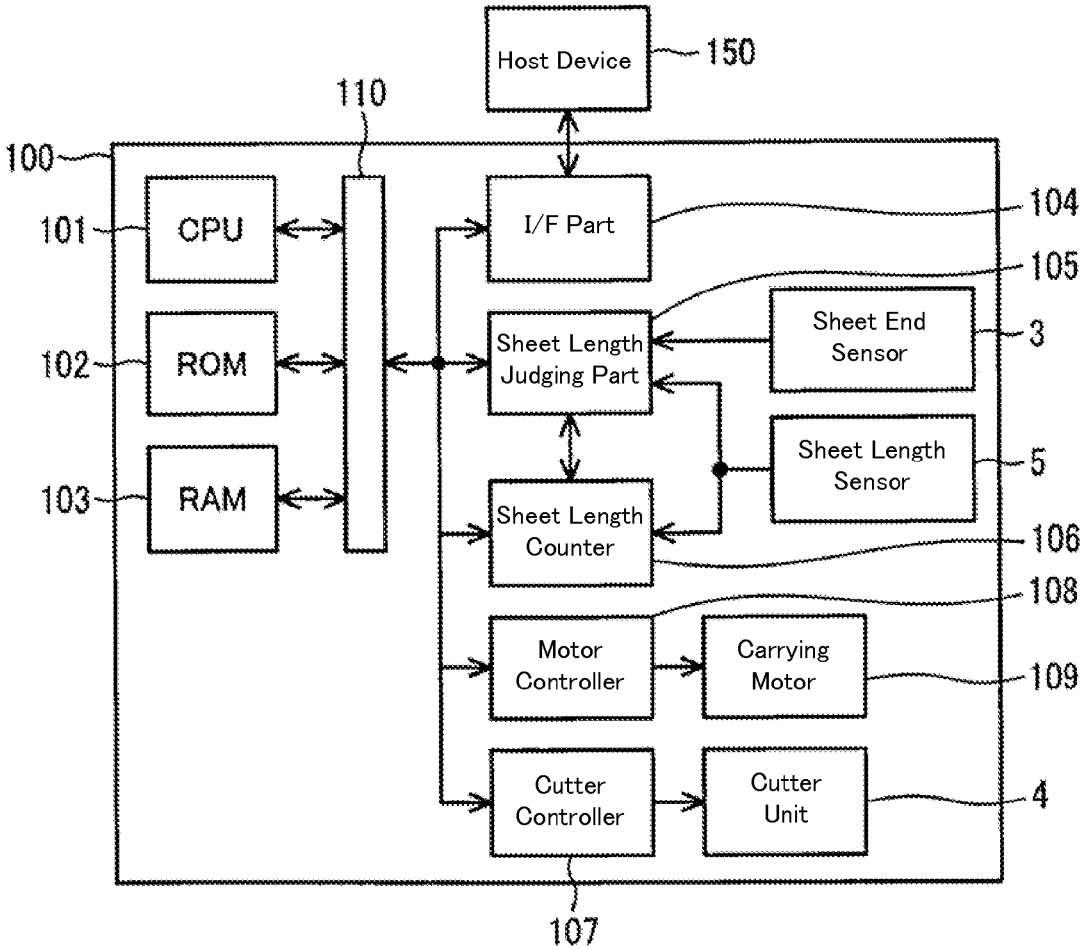
FIG. 4 is a block diagram illustrating a configuration of the roll sheet feeding part according to the first embodiment.

FIG. 4 illustrates a block diagram illustrating a configuration of the roll sheet feeding part according to the first embodiment. In FIG. 4, the roll sheet feeding part 100 feeds a sheet to the printing part 200 based on the sheet feeding instruction and the sheet length data transmitted from the host device 150 such as a host computer. Here, the sheet length data is generated according to a setting that is input by a user using the host device 150, and is information about the length (requested sheet length) in the carrying direction of the roll sheet 1 that is fed to the printing part 200. The width of the roll sheet 1 is constant. Further, the sheet feeding instruction is a command for the roll sheet feeding part 100 to start feeding of the roll sheet 1 that has been cut into a length based on the sheet length data.

In the present embodiment, a case is described where the host device 150 separately transmits the sheet feeding instruction and the sheet length data. However, without being limited to this, it is also possible that the sheet length data is included in the sheet feeding instruction. The roll sheet feeding part 100 is configured by, in addition to the sheet end sensor 3, the cutter unit 4, the sheet length sensor 5 that are illustrated in FIG. 1, a CPU (Central Processing Unit) 101, a ROM (Read Only Memory) 102, a RAM (Random Access Memory) 103, an I/F (Interface) part 104, a sheet length judging part 105, a sheet length counter 106, a cutter controller 107, a motor controller 108, carrying motors 109 and a data bus 110.

The data bus 110 is communicatively connected to the configuration blocks of the roll sheet feeding part 100 illustrated in FIGS. 4A and 4B. The I/F part 104 is communicatively connected to the host device 150 and receives the sheet length data and the sheet feeding instruction from the host device 150. When the I/F part 104 receives the sheet length data and the sheet feeding instruction from the host device 150, the CPU 101 starts a sheet feeding process and outputs a carrying instruction of the roll sheet 1 to the motor controller 108.

The CPU 101 is configured by a microprocessor and the like and controls the entire roll sheet feeding part 100 based on a control program (software) stored in the ROM 102. The RAM 103 is a main memory of the CPU 101 and temporarily stores the sheet length data transmitted from the host device 150 and information required to execute the control program. The motor controller 108 controls rotation driving of the carrying motors 109 based on the carrying instruction of the roll sheet 1 input from the CPU 101.

The carrying motors 109 are respectively provided for the carrying roller pair 2, the carrying roller pairs 10*a*-10*f*, and the carrying roller pairs 20, 21, and cause the respective carrying roller pairs to carry the roll sheet 1 by transmitting rotation driving to the respective carrying roller pairs. The carrying motors 109 are stepping motors in each of which the rotation driving is controlled by a pulse signal that is input from the motor controller 108, a rotation angle (carrying distance) is controlled by a number of the input pulse signals (number of steps), and a rotation speed (carrying speed) is controlled by a frequency of the pulse signal.

Further, when the cut slack is generated, the carrying motors 109 are controlled by the motor controller 108 so that the carrying speed of the carrying roller pairs 10*a*-10*f* is faster than the carrying speed of the carrying roller pairs 20-22. After the cut slack is generated, when the carrying roller pairs 10*a*-10*f* are stopped and the roll sheet 1 is cut or a perforation is formed in the roll sheet 1, the carrying motors 109 of the carrying roller pairs 10*a*-10*f* are controlled by the motor controller 108 to stop carrying of the roll sheet 1.

The sheet length counter 106 is started by the sheet length sensor 5 when a signal is input that indicates that the leading edge of the roll sheet 1 in the carrying direction is detected, and counts the number of steps of the carrying motor 109 starting from the time when the leading edge of the roll sheet 1 is detected in order to obtain the length (carrying distance) of the roll sheet 1 starting from the leading edge of the roll sheet 1. For the following description of the sheet length judging part 105, the number of steps is indicated as "T." The sheet length judging part 105 judges whether or not a length from the leading edge of the carried roll sheet 1 to the blade of the cutter (the full cutter part 11 or the perforation cutter part 12) of the cutter unit 4 is the requested sheet length. To simplify the description, installation positions of the full cutter part 11 and the perforation cutter part 12 are assumed to be the same.

Here, to describe a judging method of the requested sheet length that the sheet length judging part 105 performs, information of the requested sheet length contained in the received sheet length data is converted to a number of steps of the carrying motor 109 and the result is indicated as "X." Further, when the carrying roller pairs 10*a*-10*f* are stopped and the roll sheet 1 is cut or a perforation is formed in the roll sheet 1, the number of steps of the carrying motor 109 during the time period in which the carrying speed of the carrying roller pairs 10*a*-10*f* is reduced is indicated as "Y." The carrying distance from the sheet length sensor 5 to the blade of the cutter of the cutter unit 4 is converted to a number of steps and the result is indicated as "Z." Then, when the roll sheet 1 is cut by the cutter unit 4 when the above-described number of steps of "T" matches the numbers of steps of "X-Y-Z," the length of the roll sheet 1 becomes the requested sheet length.

Thus, the sheet length judging part 105 judges whether or not the number of steps of "T" and the numbers of steps of "X-Y-Z" match, and, when it is judged that the numbers match, outputs to the motor controller 108 an instruction to stop the carrying roller pairs 10*a*-10*f*. The cutter controller 107 controls an operation of the cutter unit 4. After the sheet length judging part 105 outputs to the motor controller 108 the instruction to stop the carrying roller pairs 10*a*-10*f*, the cutter controller 107 drives the cutter unit 4 to cut the roll sheet 1 or form a perforation in the roll sheet 1 at the requested sheet length.

Figure 5:
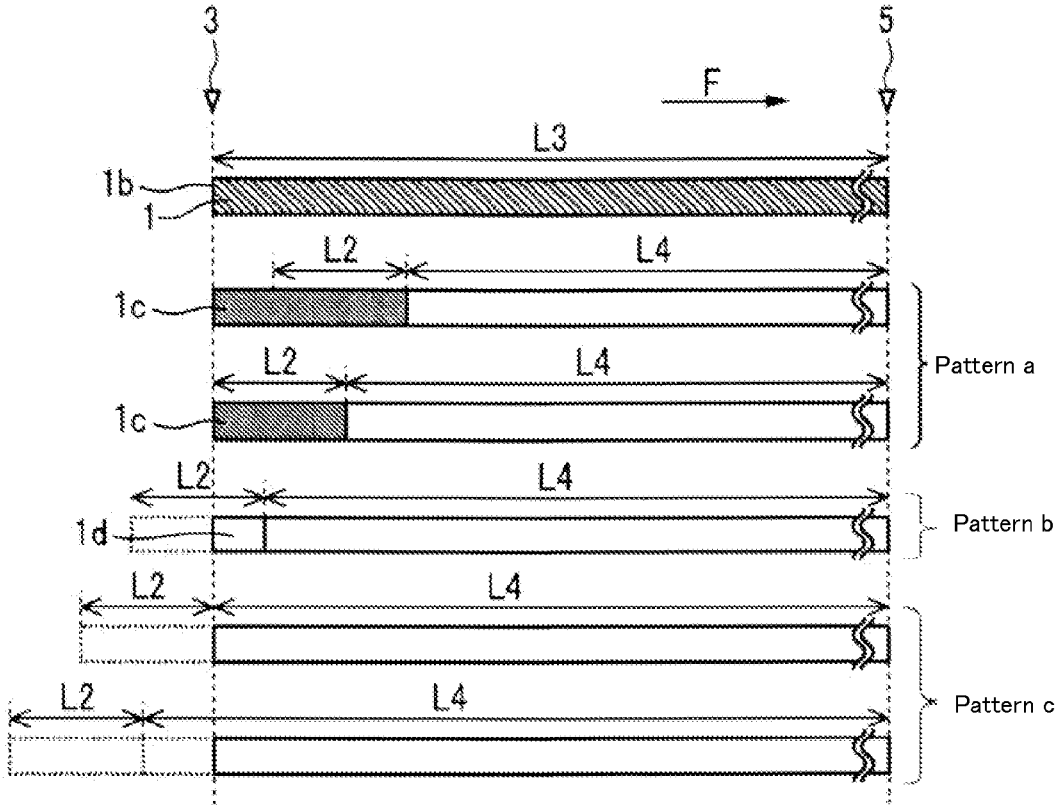
FIG. 5 is an explanatory diagram illustrating a relation between a remaining sheet length of a roll sheet and a length obtained by adding a carriable sheet length to a requested sheet length in the first embodiment.

An operation of the configuration described above is described. FIG. 5 illustrates an explanatory diagram illustrating a relation between a remaining sheet length of the roll sheet in the first embodiment and a length obtained by adding a carriable sheet length to the requested sheet length. That is, FIG. 5 illustrates a relation between a length (remaining sheet length L3) of the roll sheet 1 that actually remains from the sheet length sensor 5 to the sheet end sensor 3 when the sheet end sensor 3 detects the trailing edge 1*b* of the roll sheet 1 in the carrying direction indicated by the arrow F in FIG. 1 and a length obtained by adding a minimum length of the roll sheet 1 that can be carried (carriable sheet length L2) to the length of the roll sheet 1 that is required based on the sheet length data (requested sheet length L4). The carriable sheet length L2 is a longest interval between carrying roller pairs among the carrying roller pairs 2, 10*b*-10*f*, 20-22 illustrated in FIG. 1.

In FIG. 5, patterns of the sheet feeding process that the roll sheet feeding part 100 performs can be roughly divided into three patterns based on the relation between the remaining sheet length L3 and the length obtained by adding the carriable sheet length L2 to the requested sheet length L4. The three patterns are indicated as patterns a, b, c and are described based on FIG. 5 with reference to FIG. 1.

(Pattern A)

The pattern a is a case where the length obtained by adding the requested sheet length L4 to the carriable sheet length L2 is equal to or shorter than the remaining sheet length L3 (L2+L4≤L3). In this case, the cutter unit 4 cuts the roll sheet 1 at a trailing edge of the requested sheet length L4 in the carrying direction indicated by the arrow F in FIG. 1. The roll sheet 1 cut to the length of the requested sheet length L4 is fed to the printing part 200. Further, a cut piece 1*c* has a length equal to or longer than the carriable sheet length L2 and thus is carried by the carrying roller pairs to the cover 8 to be removed by a user.

(Pattern B)

The pattern b, which is the above-described "predetermined condition," is a case where the length obtained by adding the requested sheet length L4 to the carriable sheet length L2 is longer than the remaining sheet length L3 (L2+L4>L3), and the requested sheet length L4 is shorter than the remaining sheet length L3 (L4<L3). Putting it another way, L2+L4>L3>L4 is satisfied. L2 In this case, when the roll sheet 1 is cut at the trailing edge of the requested sheet length L4 in the carrying direction indicated by the arrow F in FIG. 1, the length of the remaining roll sheet 1 is shorter than the length of the carriable sheet length L2. Therefore, the remaining roll sheet 1 cannot be carried by the carrying roller pairs and becomes factor causing sheet jam and the like. Thus, the cutter unit 4 does not cut the roll sheet 1. Further, the remaining roll sheet 1 is added as a blank part 1*d* to the roll sheet 1 of the requested sheet length L4. The cutter unit 4 forms a perforation at a boundary between the requested sheet length L4 and the blank part 1*d* to allow a user to separate the blank part 1*d* after printing.

(Pattern C)

The pattern c is a case where the requested sheet length L4 is equal to or longer than the remaining sheet length L3 (L4≥L3). In this case, the roll sheet 1 having a length of the requested sheet length L4 cannot be fed to the printing part 200. Therefore, the roll sheet 1 of the remaining sheet length L3, as it is, is ejected to the printing part 200. By ejecting the roll sheet 1 that is shorter than the requested sheet length L4 without retaining it inside the roll sheet feeding part 100, an operation as an error handling process to remove the roll sheet 1 that is shorter than the requested sheet length L4 from the inside of the roll sheet feeding part 100 can be omitted.

When L4=L3 is satisfied, the requested sheet length L4 and the remaining sheet length L3 are equal. Thereby, it is possible to feed the roll paper 1 that is the requested sheet length L4 without the cutting process. However, considering cases where the sheet remains inside the roll sheet feeding part 100 due to detection variations performed by the paper end sensor 3 or sheet length sensor 5, L4=L3 is included in pattern c.

Figure 6:
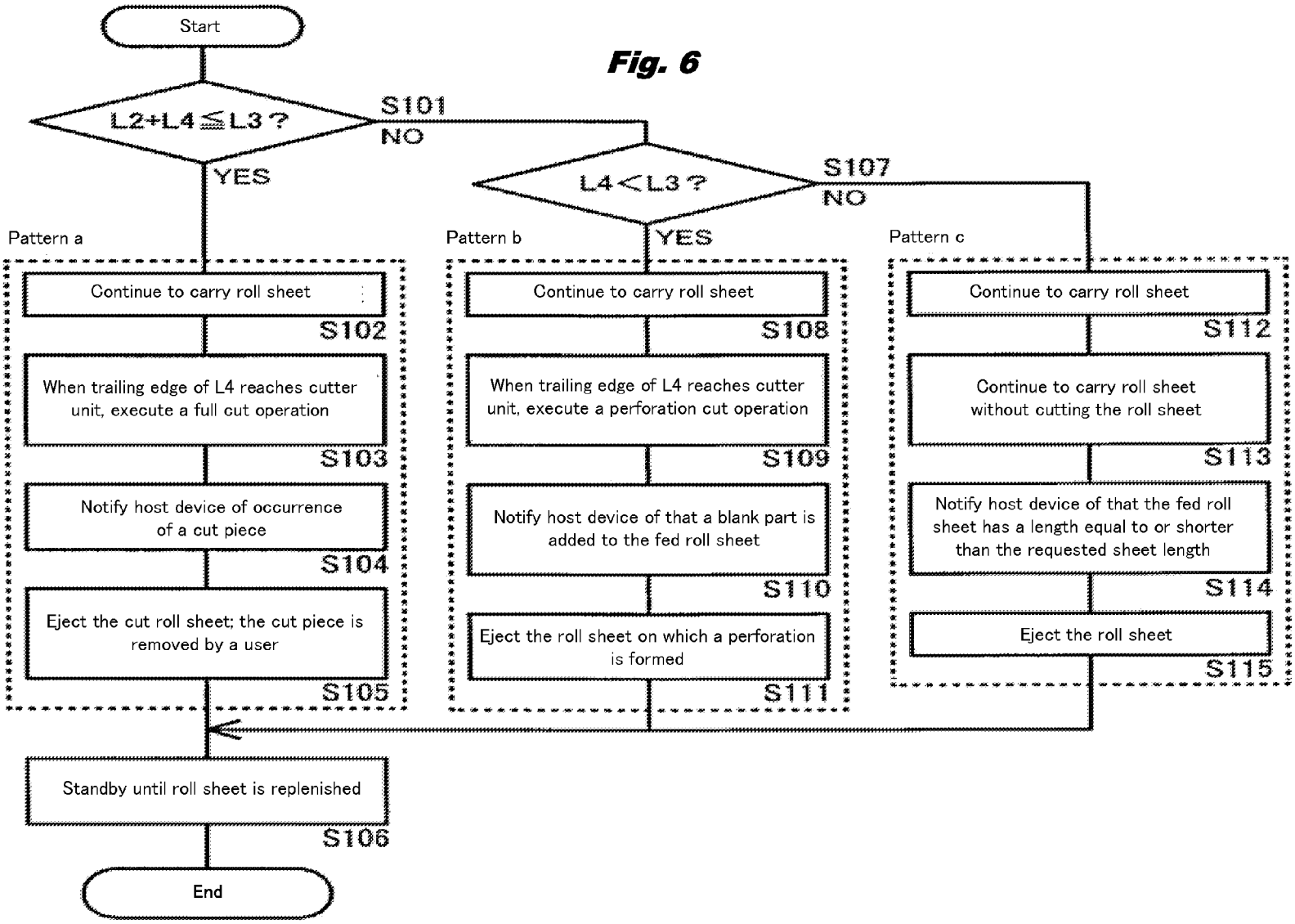
FIG. 6 is a flow diagram illustrating flow of a sheet feeding process at a trailing edge of a roll sheet in the first embodiment.

Next, a description is given of a sheet feeding process including the three patterns following steps indicated by "S" in a flow diagram of FIG. 6 that illustrates flow of the sheet feeding process at the trailing edge of the roll sheet in the first embodiment, the description being based on FIG. 5 with reference to FIGS. 1 and 4. Further, processes of S102-S105 correspond to a sheet feeding process of the pattern a illustrated in FIG. 5; processes of S108-S111 correspond to a sheet feeding process of the pattern b; and processes of S112-S115 correspond to a sheet feeding process of the pattern c. The description starts from a state in which a sheet feeding instruction has been transmitted from the host device 150, the carrying roller pairs 10*a*-10*f* have started to carry the roll sheet 1, and the sheet end sensor 3 has detected the trailing edge 1*b* of the roll sheet 1.

S101: The sheet length judging part 105 judges whether or not the length obtained by adding the requested sheet length L4 to the carriable sheet length L2 is equal to or shorter than the remaining sheet length L3. When it is judged that the length is equal to or shorter than the remaining sheet length L3, the processing proceeds to S102 at which the sheet feeding process of the pattern a is performed. When it is judged that the length is not equal to or shorter than the remaining sheet length L3, the processing proceeds to S107.

S102: The motor controller 108 causes the carrying roller pairs 10*a*-10*f* to continue to carry the roll sheet 1.

S103: When the sheet length judging part 105 judges that the trailing edge of the requested sheet length L4 in the carrying direction has reached the cutter unit 4, the cutter controller 107 causes the cutter unit 4 to execute a full cut operation in which the roll sheet 1 is completely cut. The cut piece 1*c* generated by the full cut operation has a length equal to or longer than the carriable sheet length L2 and thus is carried by the carrying roller pairs 10*e*, 10*f* and the carrying roller pair 20 or 21 to the cover 8. S104: The CPU 101 notifies the host device 150 of information indicating that the cut piece 1*c* is generated.

S105: After the carrying roller pair 22 ejects the roll sheet 1 that has been cut to the requested sheet length L4, the cover 8 is opened by a user and the cut piece 1*c* is removed. S106: The CPU 101 is in a standby state until the roll sheet 1 is newly replenished by a user, and the present processing ends. S107: The sheet length judging part 105 judges whether or not the requested sheet length L4 is shorter than the remaining sheet length L3. When it is judged that the requested sheet length L4 is shorter than the remaining sheet length L3, the processing proceeds to S108 at which the sheet feeding process of the pattern b is performed. When it is judged that the requested sheet length L4 is not shorter than the remaining sheet length L3, the processing proceeds to S112 at which the sheet feeding process of the pattern c is performed.

S108: The motor controller 108 causes the carrying roller pairs 10*a*-10*f* to continue to carry the roll sheet 1. S109: When the sheet length judging part 105 judges that the trailing edge of the requested sheet length L4 in the carrying direction has reached the cutter unit 4, the cutter controller 107 causes the cutter unit 4 to execute a perforation cut operation in which a perforation is formed in the roll sheet 1. S110: Since the carriable sheet length L2 cannot be ensured, the CPU 101 notifies the host device 150 of information indicating that the blank part 1*d* has been added to the roll sheet 1 that is fed to the printing part 200.

S111: The motor controller 108 causes the carrying roller pair 22 to eject roll sheet 1 in which the perforation is formed to the printing part 200. As described above, in the case of the pattern b of the present embodiment, the perforation is formed at the boundary between the requested sheet length L4 and the blank part 1*d*, and a roll sheet 1 that would have an uncarriable short length when it is cut is fed as the blank part 1*d* to the printing part 200. Thereby, after printing is performed by the printing part 200, a user can separate the blank part 1*d* along the perforation so that the printed roll sheet 1 has a length of the requested sheet length L4. Therefore, when the user removes the blank part 1*d* from the printed roll sheet 1, an operation to measure the length of the blank part 1*d* can be omitted.

S112: The motor controller 108 causes the carrying roller pairs 10*a*-10*f* to continue to carry the roll sheet 1. S113: When the sheet length judging part 105 judges that the trailing edge of the requested sheet length L4 in the carrying direction has reached the cutter unit 4, the cutter controller 107 does not cause the cutter unit 4 to operate. The motor controller 108 causes the carrying roller pairs 10*a*-10*f* to continue to carry the roll sheet 1. S114: The CPU 101 notifies the host device 150 of information indicating that the roll sheet 1 that is fed to the printing part 200 has a length equal to or shorter than the requested sheet length L4. S115: The motor controller 108 causes the carrying roller pair 22 to eject the roll sheet 1 from the roll sheet feeding part 100.

As described above, in the first embodiment, in the sheet feeding process of the pattern b, when the roll sheet is fed as the blank part without being cut, the perforation is formed at the boundary between the requested sheet length L4 and the blank part. Thereby, a user can separate the blank part along the perforation. Therefore, an effect is obtained that, when the user removes the blank part from the printed roll sheet, the operation to measure the length of the blank part can be omitted. Further, in the present embodiment, a case is described where the full cutter part and the perforation cutter part of the cutter unit are described as separate configuration components. However, without being limited to this, it is also possible that a single configuration is adopted in which a shape of a blade and a control method are applied that allow cutting and forming a perforation to be performed using a single blade.

Additional Explanation for First Embodiment

Further, in the present embodiment, a case is described where sheet feeding is performed by forming a perforation in the roll sheet 1 by the perforation cutter part 12. However, without being limited to this, for example, it is also possible to adopt a partial cut in which cuts are formed in the roll sheet 1 in a carriable state in which the roll sheet 1 is connected by one point at a center of the roll sheet 1. Further, in the present embodiment, a case is described where the print device includes the roll sheet feeding part and the printing part. However, without being limited to this, the present invention also applies to a configuration including only the roll sheet feeding part such as a feeding device that feeds a medium such as a paper sheet, a cloth and a plastic film.

Second Embodiment

In the first embodiment, in the sheet feeding process of the pattern b, when the roll sheet 1 is fed as the blank part 1*d* without being cut, the perforation is formed at the boundary between the requested sheet length L4 and the blank part 1*d*, and thereby a user separate the blank part 1*d* along the perforation. However, when an interval between the cutter unit 4 and the carrying roller pair 10*f* is longer than the length of the blank part 1*d*, a perforation cannot be formed in the roll sheet 1. Therefore, when the roll sheet feeding part 100 of the present embodiment performs the sheet feeding process of the pattern b, a perforation is not formed in the roll sheet 1; instead, the roll sheet 1 is carried to the printing part 200, and a line indicating a cutting position of the requested sheet length is printed in the roll sheet 1.

Figure 7:
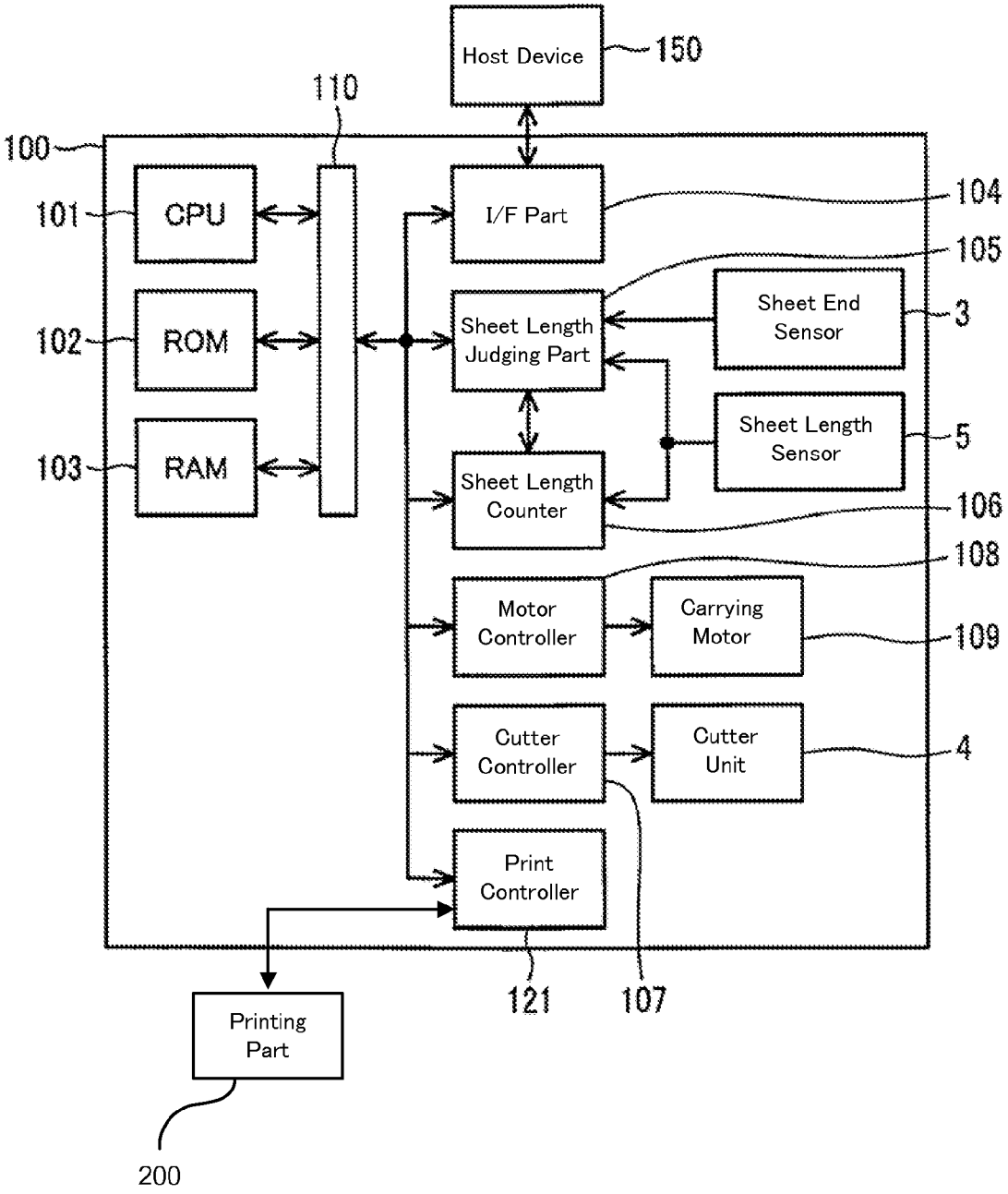
FIG. 7 is a block diagram illustrating a configuration of a roll sheet feeding part according to the second embodiment.

The roll sheet feeding part 100 and the printing part 200 in the present embodiment are the same as in the configuration of the first embodiment illustrated in FIG. 1 and thus are indicated using the same reference numerals and description thereof is omitted. FIG. 7 illustrates a block diagram illustrating a configuration of the roll sheet feeding part according to the second embodiment. In FIG. 7, the roll sheet feeding part 100 in the present embodiment has a configuration obtained by adding a print controller 121 to the configuration of the first embodiment illustrated in FIG. 4. Parts that are the same as in the configuration of the first embodiment illustrated in FIG. 4 are indicated using the same reference numerals and description thereof is omitted.

The print controller 121 is communicatively connected to the respective configuration blocks, performs control of image forming units (not illustrated in the drawings) of respective colors included in the printing part 200 based on the print data transmitted from the host device 150, and transmits print instructions to the image forming units causing the image forming units to perform printing. When the sheet end sensor 3 detects the trailing edge 1*b* of the roll sheet 1, in the case where the sheet length judging part 105 judges that is is the case of the pattern b illustrated in the first embodiment, the print controller 121 notifies the printing part 200 of information indicating a number of reaming steps before a printing position at which an image forming unit performs printing and the cutting position will match each other, and transmits an instruction to cause a line indicating the cutting position to be printed.

An operation of the configuration described above is described. Also in the present embodiment, similar to FIG. 5 described in the first embodiment, the patterns of the sheet feeding process that the roll sheet feeding part 100 performs can be roughly divided into three patterns depending on the requested sheet length L4 of which the length has been changed. The three patterns are indicated as patterns a, b, c and are described based on FIG. 5 with reference to FIG. 1. The pattern a of the present embodiment is a case where the length obtained by adding the requested sheet length L4 to the carriable sheet length L2 is equal to or shorter than the remaining sheet length L3 (L2+L4≤L3). In this case, similar to the pattern a of the first embodiment, the cutter unit 4 cuts the roll sheet 1 at the trailing edge of the requested sheet length L4 in the carrying direction indicated by the arrow F in FIG. 1. The roll sheet 1 cut to the length of the requested sheet length L4 is fed to the printing part 200. Further, a cut piece 1*c* has a length equal to or longer than the carriable sheet length L2 and thus is carried by the carrying roller pairs to the cover 8 to be removed by a user.

The pattern b of the present embodiment is a case where the length obtained by adding the requested sheet length L4 to the carriable sheet length L2 is longer than the remaining sheet length L3 (L2+L4>L3), and the requested sheet length L4 is shorter than the remaining sheet length L3 (L4<L3). Putting it another way, L2+L4>L3>L4 is satisfied. In this case, in the case of the pattern b of the first embodiment, a perforation is formed at the boundary between the requested sheet length L4 and the blank part 1*d*. However, in the case of the pattern b of the present embodiment, the printing part 200 prints a line indicating a cutting position at the boundary between the requested sheet length L4 and the blank part 1*d*.

The pattern c of the present embodiment is a case where the requested sheet length L4 is equal to or longer than the remaining sheet length L3 (L4≥L3). In this case, similar to the pattern c of the first embodiment, the roll sheet 1 having a length of the requested sheet length L4 cannot be fed to the printing part 200. Therefore, the roll sheet 1 of the remaining sheet length L3, as it is, is ejected to the printing part 200. Additionally, when L4=L3 is satisfied, the requested sheet length L4 and the remaining sheet length L3 are equal. Thereby, it is possible to feed the roll paper 1 that is the requested sheet length L4 without the cutting process. However, considering cases where the sheet remains inside the roll sheet feeding part 100 due to detection variations performed by the paper end sensor 3 or sheet length sensor 5, L4=L3 is included in pattern c. Next, a description is given of a sheet feeding process including the three patterns following steps indicated by "S" in a flow diagram of FIG. 8 that illustrates flow of the sheet feeding process at the trailing edge of the roll sheet in the second embodiment, the description being based on FIG. 5 with reference to FIGS. 1 and 7.

Further, processes of S202-S205 correspond to a sheet feeding process of the pattern a illustrated in FIG. 5; processes of S208-S212 correspond to a sheet feeding process of the pattern b; and processes of S213-S216 correspond to a sheet feeding process of the pattern c. The description starts from a state in which a sheet feeding instruction has been transmitted from the host device 150, the carrying roller pairs 10*a*-10*f* have started to carry the roll sheet 1, and the sheet end sensor 3 has detected the trailing edge 1*b* of the roll sheet 1.

S201: The sheet length judging part 105 judges whether or not the length obtained by adding the requested sheet length L4 to the carriable sheet length L2 is equal to or shorter than the remaining sheet length L3. When it is judged that the length is equal to or shorter than the remaining sheet length L3, the processing proceeds to S202 at which the sheet feeding process of the pattern a is performed. When it is judged that the length is not equal to or shorter than the remaining sheet length L3, the processing proceeds to S207. S202: The motor controller 108 causes the carrying roller pairs 10*a*-10*f* to continue to carry the roll sheet 1. Further, the printing part 200 performs printing on the carried roll sheet 1 based on the print data transmitted from the host device 150.

S203: When the sheet length judging part 105 judges that the trailing edge of the requested sheet length L4 in the carrying direction has reached the cutter unit 4, the cutter controller 107 causes the cutter unit 4 to execute a full cut operation in which the roll sheet 1 is completely cut. The cut piece 1*c* generated by the full cut operation has a length equal to or longer than the carriable sheet length L2 and thus is carried by the carrying roller pairs 10*e*, 10*f* and the carrying roller pair 20 or 21 to the cover 8. S204: The CPU 101 notifies the host device 150 of information indicating that the cut piece 1*c* is generated.

S205: After the carrying roller pair 22 ejects the roll sheet 1 that has been cut to the requested sheet length L4, the cover 8 is opened by a user and the cut piece 1*c* is removed. S206: The CPU 101 is in a standby state until the roll sheet 1 is newly replenished by a user, and the present processing ends. S207: The sheet length judging part 105 judges whether or not the requested sheet length L4 is shorter than the remaining sheet length L3. When it is judged that the requested sheet length L4 is shorter than the remaining sheet length L3, the processing proceeds to S208 at which the sheet feeding process of the pattern b is performed. When it is judged that the requested sheet length L4 is not shorter than the remaining sheet length L3, the processing proceeds to S213 at which the sheet feeding process of the pattern c is performed.

S208: The motor controller 108 causes the carrying roller pairs 10*a*-10*f* to continue to carry the roll sheet 1. Further, the printing part 200 performs printing on the carried roll sheet 1 based on the print data transmitted from the host device 150. S209: Even when the sheet length judging part 105 judges that the trailing edge of the requested sheet length L4 in the carrying direction has reached the cutter unit 4, the cutter controller 107 does not cause the cutter unit 4 to operate. The motor controller 108 causes the carrying roller pairs 10*a*-10*f* to continue to carry the roll sheet 1.

S210: The print controller 121, which is data-communication capably connected to the printing part 200, causes the printing part 200 to print a line indicating a cutting position of the roll sheet 1 when the cutting position reaches the image forming unit (not illustrated in the drawings). S211: Since the carriable sheet length L2 cannot be ensured, the CPU 101 notifies the host device 150 of information indicating that the blank part 1*d* has been added to the roll sheet 1 that is fed to the printing part 200. S212: The printing part 200 ejects the roll sheet 1 on which the line indicating the cutting position is printed.

As described above, in the case of the pattern b of the present embodiment, the line indicating the cutting position is printed at the boundary between the requested sheet length L4 and the blank part 1*d*. Thereby, after printing is performed by the printing part 200, a user can cut the blank part 1*d* along the line indicating the cutting position so that the printed roll sheet 1 has a length of the requested sheet length L4. Therefore, when the user removes the blank part 1*d* from the printed roll sheet 1, an operation to measure the length of the blank part 1*d* can be omitted.

S213: The motor controller 108 causes the carrying roller pairs 10*a*-10*f* to continue to carry the roll sheet 1. Further, the printing part 200 stops printing that is performed on the carried roll sheet 1. S214: Even when the sheet length judging part 105 judges that the trailing edge of the requested sheet length L4 in the carrying direction has reached the cutter unit 4, the cutter controller 107 does not cause the cutter unit 4 to operate. The motor controller 108 causes the carrying roller pairs 10*a*-10*f* to continue to carry the roll sheet 1.

S215: The CPU 101 notifies the host device 150 of information indicating that the roll sheet 1 that is fed to the printing part 200 has a length equal to or shorter than the requested sheet length L4. S216: The motor controller 108 causes the carrying roller pair 22 to eject the roll sheet 1. As described above, in the case of the pattern c of the present embodiment, by ejecting the roll sheet 1 that is even shorter than the requested sheet length L4 from the roll sheet feeding part 100 without retaining it, an operation to remove the roll sheet 1 that is shorter than the requested sheet length L4 from the inside of the roll sheet feeding part 100 can be omitted.

As described above, in the second embodiment, in the sheet feeding process of the pattern b, when the roll sheet is fed as the blank part without being cut, the line indicating the cutting position is printed at the boundary between the requested sheet length L4 and the blank part. Thereby, a user can cut the blank part along the line indicating the cutting position. Therefore, an effect is obtained that, when the user removes the blank part 1*d* from the printed roll sheet 1, the operation to measure the length of the blank part 1*d* can be omitted. Similar to the configuration of the cutter unit of the first embodiment, the configuration of the cutter unit of the present embodiment includes the perforation cutter part. However, without being limited to this, it is also possible that the perforation cutter part is not configured in the cutter unit.

Third Embodiment

Figure 9:
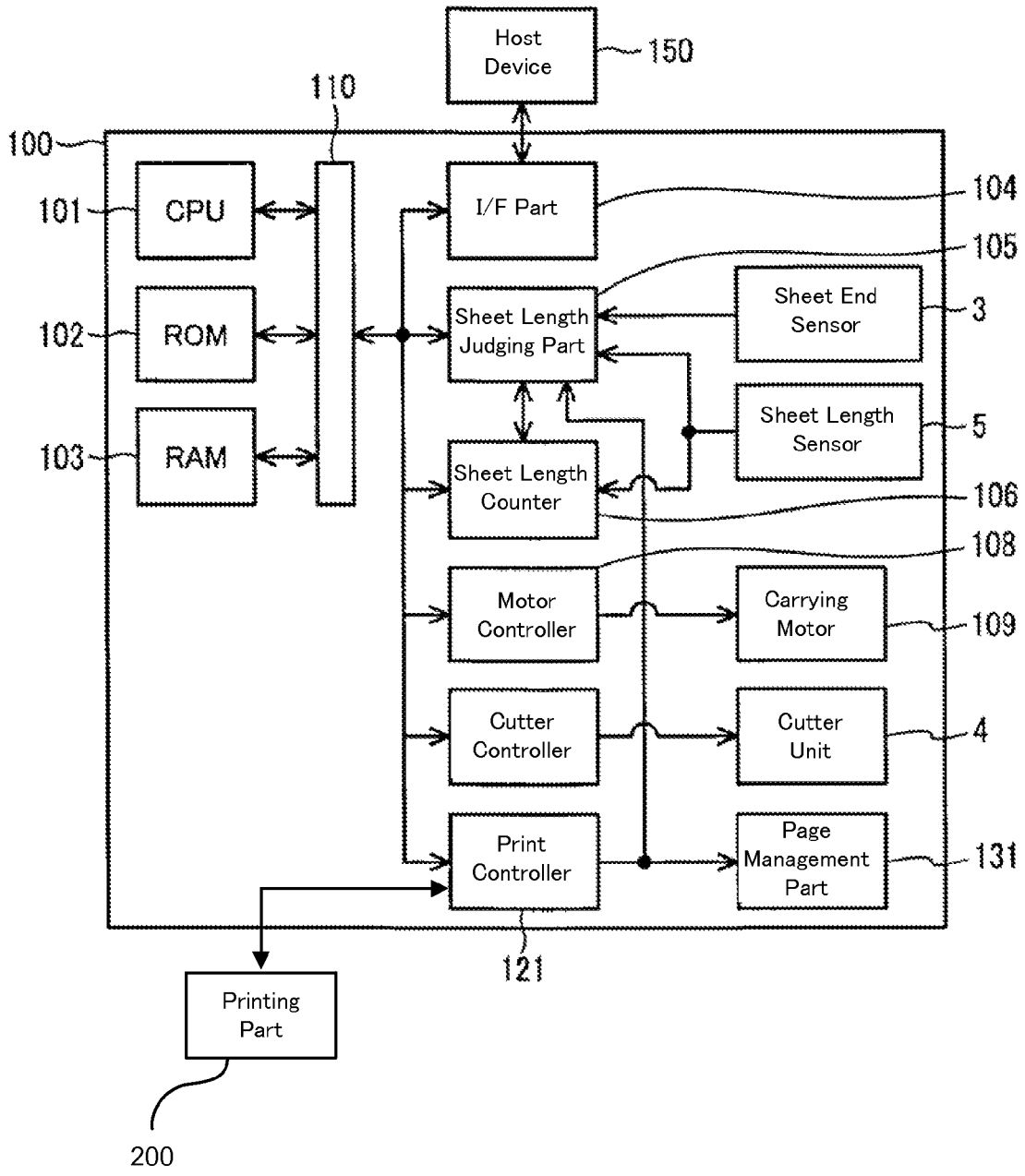
FIG. 9 is a block diagram illustrating a configuration of a roll sheet feeding part according to the third embodiment.

In a case where the print data transmitted from the host device 150 is configured by a plurality of page units, when the sheet end sensor 3 detects the trailing edge 1*b* of the roll sheet 1, and when the sheet length judging part 105 judges that not all of the pages can be printed, in addition to the operation of printing the line indicating the cutting position in the second embodiment, the print device 300 of the third embodiment prints as much as possible the pages on the roll sheet 1 and performs printing indicating the cutting position at a trailing edge of the printed pages. FIG. 9 illustrates a block diagram illustrating a configuration of the roll sheet feeding part according to the third embodiment. In FIG. 9, the roll sheet feeding part 100 in the present embodiment has a configuration obtained by adding a page management part 131 to the configuration of the third embodiment illustrated in FIG. 7.

Parts that are the same as in the configuration of the second embodiment illustrated in FIG. 7 are indicated using the same reference numerals and description thereof is omitted. The page management part 131 is communicatively connected to the sheet length judging part 105 and the print controller 121, manages the print data transmitted from the host device 150 in page units, judges how many pages can be printed in the remaining sheet length L3 (which is judged by the sheet length judging part 105) when the sheet end sensor 3 detects the trailing edge 1*b* of the roll sheet 1, and notifies the print controller 121 of the judging result.

Figure 10:
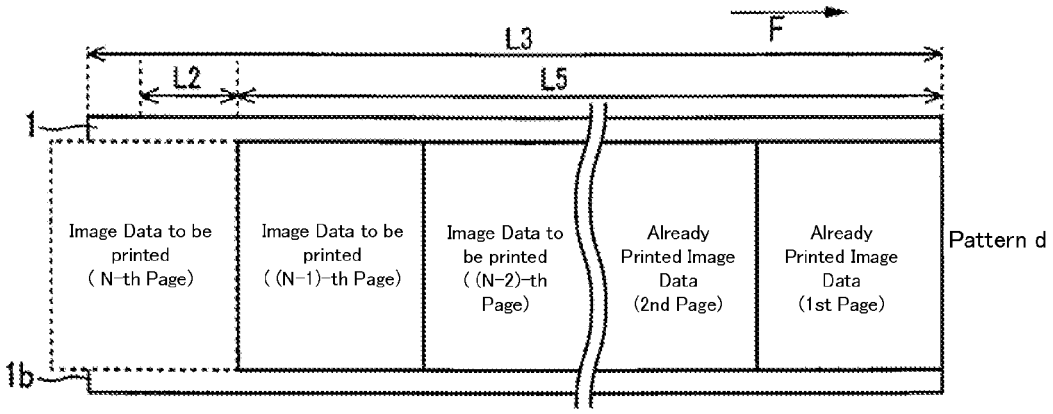
FIG. 10 is an explanatory diagram illustrating a relation between a remaining sheet length of a roll sheet in the third embodiment and a length of image data represented in page units.
Figure 11:
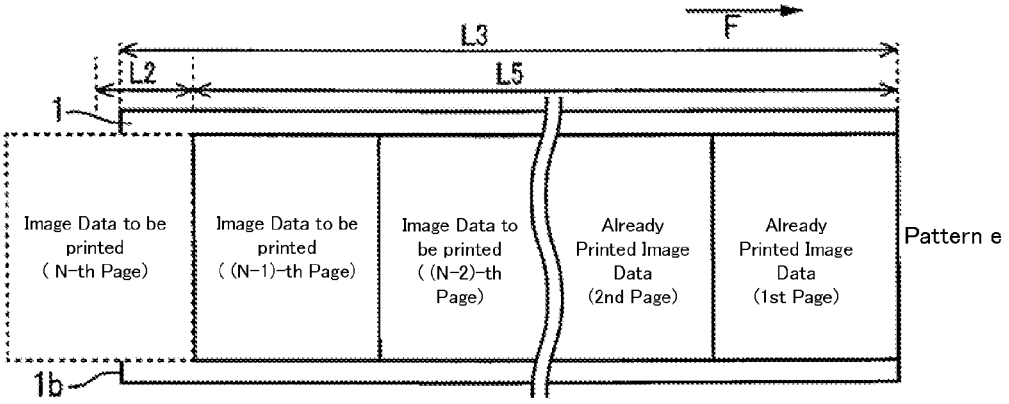
FIG. 11 is an explanatory diagram illustrating a relation between the remaining sheet length of the roll sheet in the third embodiment and the length of the image data represented in the page units.

An operation of the configuration described above is described. FIGS. 10 and 11 illustrate explanatory diagrams illustrating a relation between a remaining sheet length of the roll sheet in the third embodiment and a length of the image data represented in page units. That is, FIGS. 10 and 11 illustrate a relation between the length (remaining sheet length L3) of the roll sheet 1 that actually remains from the sheet length sensor 5 to the sheet end sensor 3 when the sheet end sensor 3 detects the trailing edge 1*b* of the roll sheet 1 in the carrying direction indicated by the arrow F in FIG. 1 and a length obtained by adding the minimum length of the roll sheet 1 that can be carried (the carriable sheet length L2) to a number of pages on which the image data generated from the print data can be printed (a printable sheet length L5).

Further, FIGS. 10 and 11 illustrate examples in which an N-th page, which is a last page, cannot be printed. Therefore, from a first page to an (N−1)-th page of the image data is the printable sheet length L5. Patterns of the sheet feeding process that the roll sheet feeding part 100 performs can be roughly divided into two patterns based on the relation between the remaining sheet length L3 and the length obtained by adding the carriable sheet length L2 to the printable sheet length L5. The two patterns are indicated as patterns d, e and are described based on FIG. 11 with reference to FIG. 1.

As illustrated in FIG. 10, the pattern d of the present embodiment is a case where the length obtained by adding the printable sheet length L5 to the carriable sheet length L2 is equal to or shorter than the remaining sheet length L3 ($L2+L5 \leq L3$). In this case, the cutter unit 4 cuts the roll sheet 1 at a trailing edge of the printable sheet length L5 in the carrying direction indicated by the arrow F in FIG. 1. The roll sheet 1 cut to the length of the printable sheet length L5 is fed to the printing part 200. Further, a cut piece including the trailing edge 1*b* of the roll sheet 1 is generated. The cut piece has a length equal to or longer than the carriable sheet length L2 and thus is carried to the cover 8 to be removed by a user.

The pattern e of the present embodiment is a case where the length obtained by adding the printable sheet length L5 to the carriable sheet length L2 is longer than the remaining sheet length L3, and the printable sheet length L5 is equal to or shorter than the remaining sheet length L3 ($L5 \leq L3 < L2+L5$). In this case, when the roll sheet 1 is cut at the trailing edge of the printable sheet length L5 in the carrying direction indicated by the arrow F in FIG. 1, the length of the remaining roll sheet 1 is shorter than the length of the carriable sheet length L2. Therefore, the remaining roll sheet 1 cannot be carried by the carrying roller pairs and becomes factor causing sheet jam and the like. Thus, the cutter unit 4 does not cut the roll sheet 1.

Further, the remaining roll sheet 1 is added as a blank part to the roll sheet 1 of the printable sheet length L5. The printing part 200 prints a line indicating a cutting position at a boundary between the printable sheet length L5 and the blank part to allow a user to cut the blank part along the line indicating the cutting position after printing. When L5=L3, without cutting, the roll sheet 1 of the printable sheet length L5 can be fed. However, here, this case is included in the condition for which the sheet feeding process of the pattern e is performed.

Figure 12:
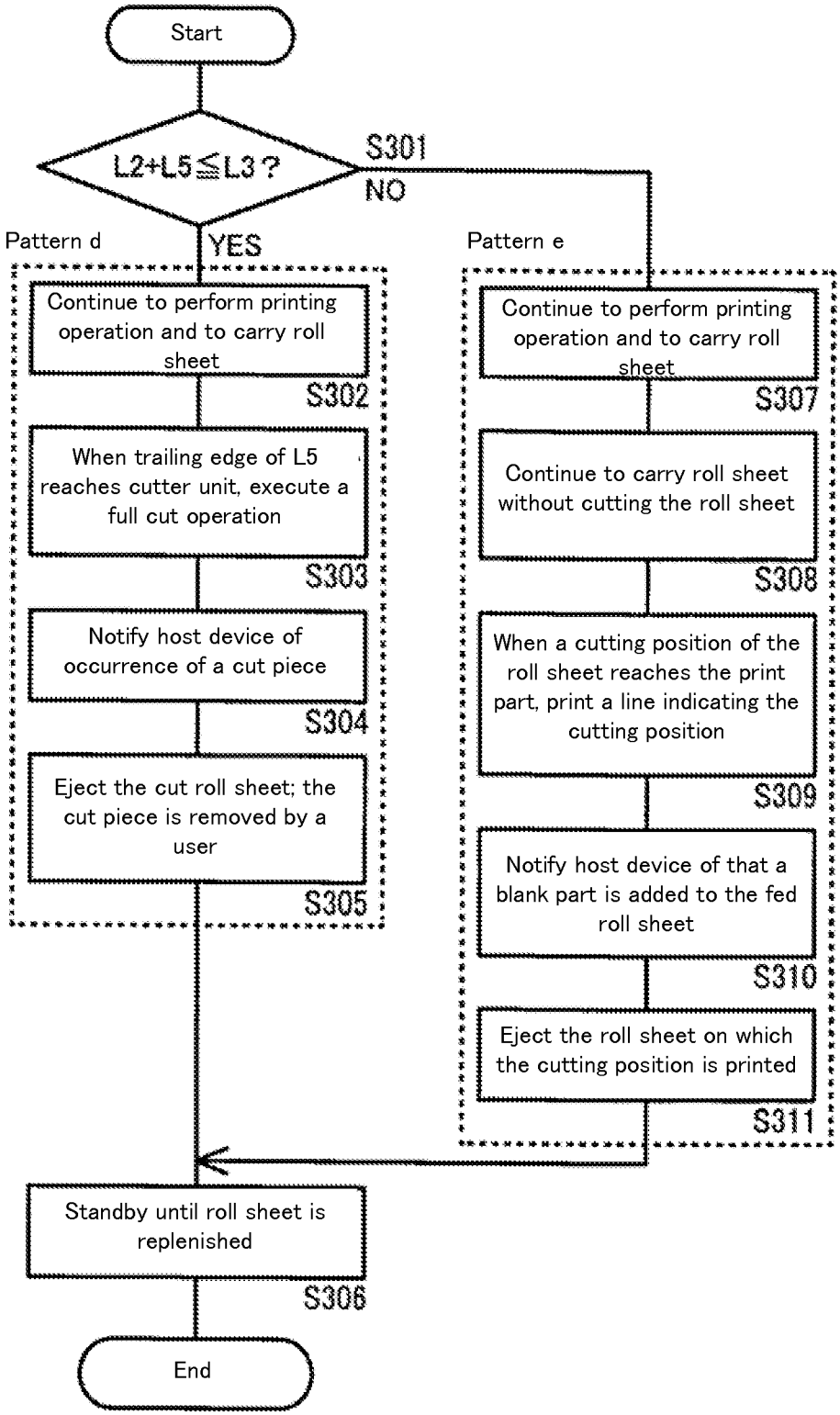
FIG. 12 is a flow diagram illustrating flow of a sheet feeding process at a trailing edge of a roll sheet in the third embodiment.

Next, a description is given of a sheet feeding process including the two patterns following steps indicated by "S" in a flow diagram of FIG. 12 that illustrates flow of the sheet feeding process at the trailing edge of the roll sheet in the third embodiment, the description being based on FIG. 9 with reference to FIGS. 10 and 11. Further, processes of S302-S305 correspond to a sheet feeding process of the pattern d illustrated in FIG. 10; and processes of S307-S312 correspond to a sheet feeding process of the pattern e. The description starts from a state in which a sheet feeding instruction has been transmitted from the host device 150, the carrying roller pairs 10*a*-10*f* have started to carry the roll sheet 1, and the sheet end sensor 3 has detected the trailing edge 1*b* of the roll sheet 1.

S301: The sheet length judging part 105 judges whether or not the length obtained by adding the printable sheet length L5 to the carriable sheet length L2 is equal to or shorter than the remaining sheet length L3. When it is judged that the length is equal to or shorter than the remaining sheet length L3, the processing proceeds to S302 at which the process of the pattern d is performed. When it is judged that the length is not equal to or shorter than the remaining sheet length L3, the processing proceeds to S307. S302: The motor controller 108 causes the carrying roller pairs 10*a*-10*f* to continue to carry the roll sheet 1. Further, the printing part 200 performs printing on the carried roll sheet 1 based on the print data transmitted from the host device 150.

S303: When the sheet length judging part 105 judges that the trailing edge of the printable sheet length L5 in the carrying direction has reached the cutter unit 4, the cutter controller 107 causes the cutter unit 4 to execute a full cut operation in which the roll sheet 1 is completely cut. The cut piece generated by the full cut operation has a length equal to or longer than the carriable sheet length L2 and thus is carried by the carrying roller pairs 10*e*, 10*f* and the carrying roller pair 20 or 21 to the cover 8. S304: The CPU 101 notifies the host device 150 of information indicating that the cut piece is generated.

S305: After the carrying roller pair 22 ejects the roll sheet 1 that has been cut to the printable sheet length L5, the cover 8 is opened by a user and the cut piece is removed. S306: The CPU 101 is in a standby state until the roll sheet 1 is newly replenished by a user, and the present processing ends. S307: The motor controller 108 causes the carrying roller pairs 10*a*-10*f* to continue to carry the roll sheet 1. Further, the printing part 200 performs printing on the carried roll sheet 1 based on the print data transmitted from the host device 150.

S308: Even when the sheet length judging part 105 judges that the trailing edge of the printable sheet length L5 in the carrying direction has reached the cutter unit 4, the cutter controller 107 does not cause the cutter unit 4 to operate. The motor controller 108 causes the carrying roller pairs 10*a*-10*f* to continue to carry the roll sheet 1. S309: The print controller 121 causes the printing part 200 to print a line indicating a cutting position of the roll sheet 1 when the cutting position reaches the image forming unit (not illustrated in the drawings). S310: Since the carriable sheet length L2 cannot be ensured, the CPU 101 notifies the host device 150 of information indicating that the blank part 1*d* has been added to the roll sheet 1 that is fed to the printing part 200. S311: The printing part 200 ejects the roll sheet 1 on which the line indicating the cutting position is printed.

As described above, in the third embodiment, in the sheet feeding process of the pattern e, when the roll sheet is fed as the blank part without being cut, the line indicating the cutting position is printed at the boundary between the printable sheet length L5 and the blank part. Thereby, a user can cut the blank part along the line indicating the cutting position. Therefore, an effect is obtained that, when the user removes the blank part 1*d* from the printed roll sheet 1, the operation to measure the length of the blank part 1*d* can be omitted.

Fourth Embodiment

In the above-described first embodiment, the processes are described in which the perforation is formed in the pattern b. The series of the processes are described in S108-S111 of FIG. 6. In the second embodiment, the processes are described in which, without forming the perforation in the pattern b, the line indicating the cutting position is printed. The series of the processes are described in S208-S212 of FIG. 8. In the fourth embodiment, In the case of the pattern b, two processes, a "process in which the perforation formed (perforation process)" and a "process in which the line indicating the cutting position is printed (cutting position process)," are selectable.

In addition to the process in which the perforation is formed, the perforation process may also be a process in which a partial cut is formed.

Figure 13:
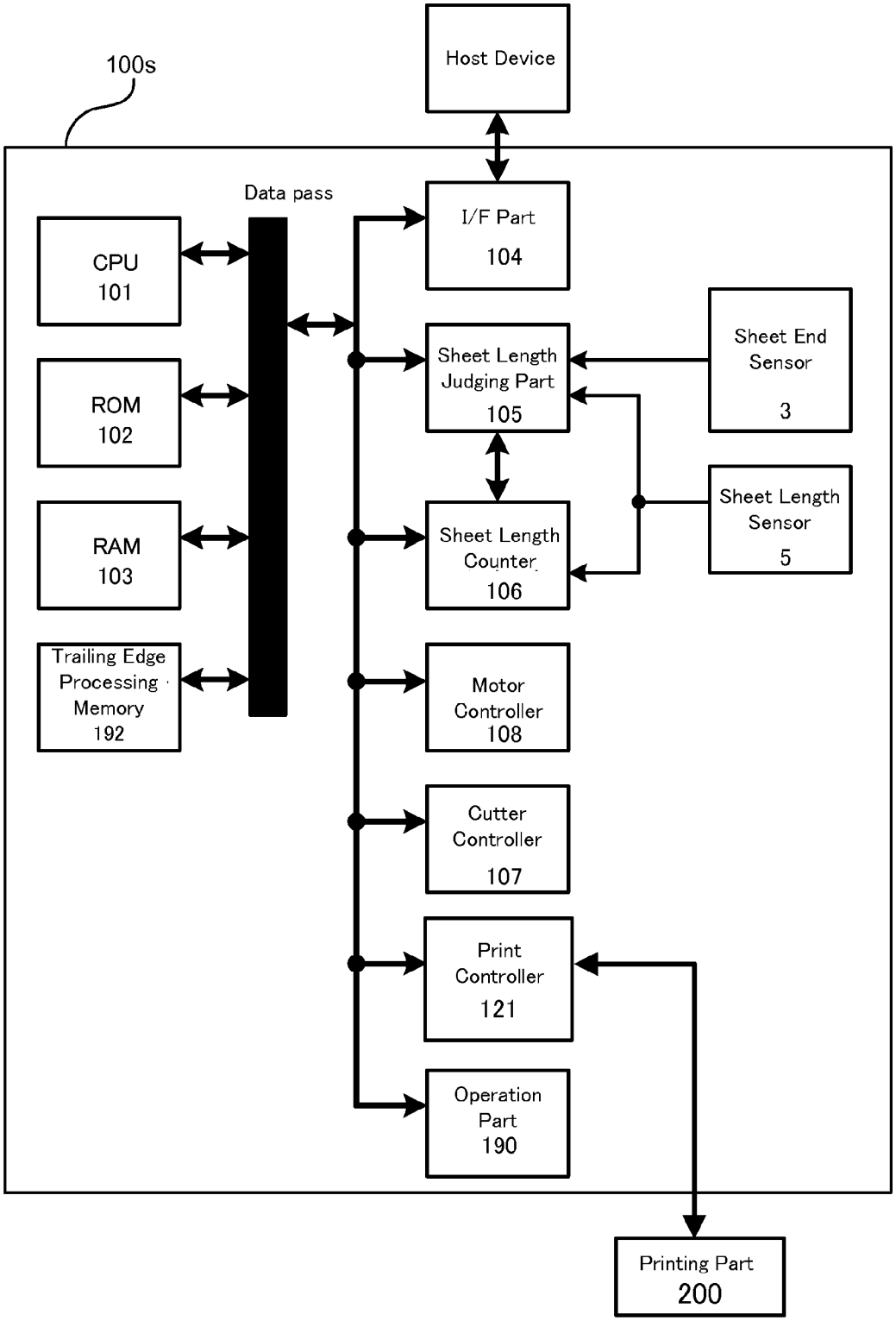
FIG. 13 is a block diagram illustrating a configuration of a roll sheet feeding part according to the fourth embodiment.

FIG. 13 illustrates a roll sheet feeding part 100*s* of the fourth embodiment. Similar to the roll sheet feeding part 100 illustrated in the second embodiment, the roll sheet feeding part 100*s* is connected to various devices via a data bus. The roll sheet feeding part 100*s* is also connected to the printing part 200 in a manner capable of data communication. The fourth embodiment is different from the second embodiment in that the following configuration components are provided.

Operation Part 190

Trailing Edge Processing Memory 192

(Operation Part 190)

The operation part 190 prompts a user to select one of the perforation process and the cutting position process in the case of the pattern b. As a form of the operation part 190, it is possible to prompt input via a touch panel supplied with the roll sheet feeding part 100*s*, and it is also possible to display a screen to prompt input with respect to the host device 150 via the I/F part 104. Selection information input by the user using the operation part 190 is transmitted as a setting value to the trailing edge processing memory 192. Content of the setting value is not limited as long as the selection of the user can be identified. In the present embodiment, the setting value is whether "formation of perforation" is selected. The setting value may be simple information. As an example, the setting value is 0 (Zero) when the "formation of perforation" is selected, and is 1 (One) when the "formation of perforation" is not selected.

(Trailing Edge Processing Memory 192)

The trailing edge processing memory 192 stores the setting value transmitted from the operation part 190. At a judging step S510 to be described later, based on the information stored in the trailing edge processing memory 192, whether the processing proceeds to the perforation formation process or to the cutting position process is judged.

Figure 14A:
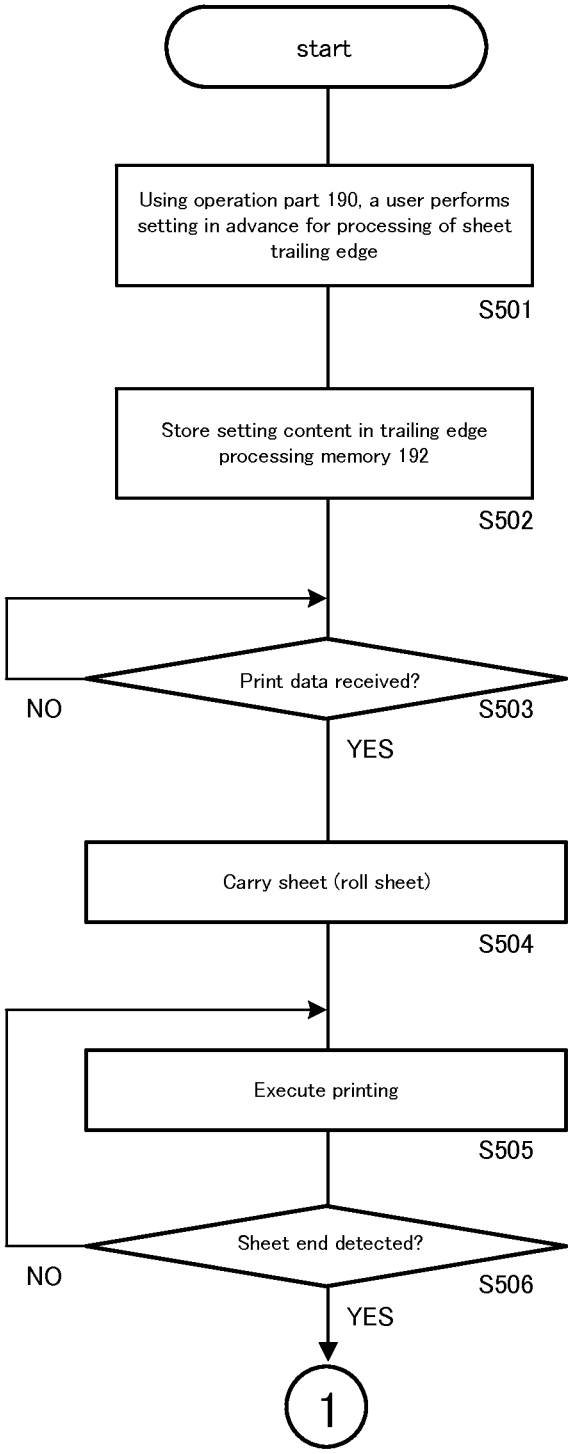
FIGS. 14A and 14B are flow diagrams illustrating low of the sheet feeding process in the fourth embodiment.
Figure 14B:
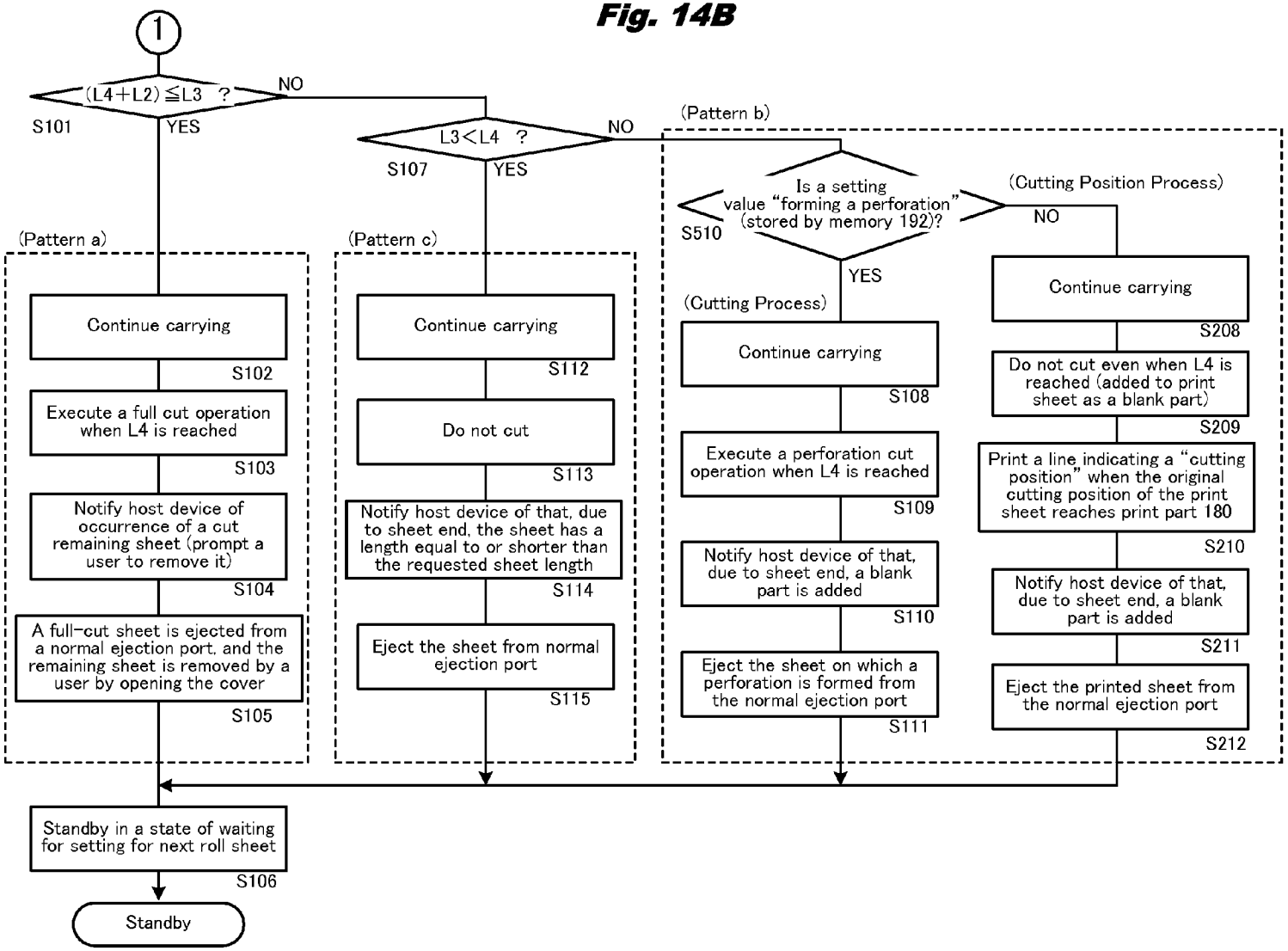

In the following, with reference to FIGS. 14A and 14B, the processing of the fourth embodiment is described.

(S501) The operation part 190 prompts the user to select a trailing edge process. Specifically, on the touch panel, "form a perforation" and "print a line indicating a cutting position" are displayed as selectable options.

(S502) Whether the user has selected "form a perforation" is transmitted as a setting value to the trailing edge processing memory 192. The trailing edge processing memory 192 stores the setting value (or user's selection).

(S503) The roll sheet feeding part 100*s* judges whether or not print data is received. The processing is in a standby state until the print data is received (NO). When the print data is received (YES), the processing proceeds to the next step.

(S504) The roll sheet feeding part 100*s* drives the carrying motor 109 to start sheet carrying.

(S505) After the sheet is carried, the printing part 200 starts printing.

(S506) Until the sheet end sensor 3 detects the trailing edged 1*b* (sheet end) of the roll sheet 1, the processing returns to S505 to continue the printing step (No). When the trailing edge 1*b* is detected (Yes), the processing proceeds to S101 illustrated in FIG. 14B.

(S101) S101 is a process described in the first embodiment. The sheet length judging part 105 judges whether or not the length obtained by adding the requested sheet length L4 to the carriable sheet length L2 is equal to or shorter than the remaining sheet length L3. When it is judged that the length is equal to or shorter than the remaining sheet length L3 (Yes), the processing proceeds to S102 at which the sheet feeding process of the pattern a is performed. When it is judged that the length is not equal to or shorter than the remaining sheet length L3 (No), the processing proceeds to S107.

(S102-S105) The processes of S102-S105 illustrated as the pattern a are the same as in the first embodiment and thus, description thereof is omitted.

(S107) S107 is also a process described in the first embodiment. The sheet length judging part 105 judges whether or not the requested sheet length L4 is shorter than the remaining sheet length L3. Similar to the first embodiment, when it is judged that the requested sheet length L4 is not shorter than the remaining sheet length L3 (No), the processing proceeds to the S112 at which the sheet feeding process of the pattern c is performed. On the other hand, when it is judged that the requested sheet length L4 is shorter than the remaining sheet length L3 (Yes), the processing proceeds to S510 that is a feature of the present embodiment.

(S112-S115) The processes of S112-S115 illustrated as the pattern c are the same as in the second embodiment and thus, description thereof is omitted.

(S510) At S510, whether the setting value stored in the trailing edge processing memory 192 is "cut with perforation" is judged. When the setting value is "cut with perforation" (Yes), the processing proceeds to the perforation process (S108-S111). When the setting value is not "cut with perforation" (No), the processing proceeds to the cutting position process (S208-S212).

(S108-S111) The perforation process (S108-S111) is the same as described in the first embodiment and thus, description thereof is omitted.

(S208-S212) The cutting position process (S208-S212) is the same as described in the second embodiment and thus, description thereof is omitted.

After the completion of S105, S115, S111 and S212, the processing proceeds to S106. At S106, the CPU 101 is in a standby state until the roll sheet 1 is newly replenished by the user, and the present processing ends.

What is claimed is:

1. A sheet feeding device that performs sheet feeding by feeding out and cutting a continuous medium, comprising:

a carrying part that is configured to perform a carrying process to carry the continuous medium;

a detection part that is configured to detect a leading edge of the continuous medium in a carrying direction and to detect a length over which the continuous medium has been carried from a detected position;

a trailing edge detection part that is arranged on an upstream side of the detection part in the carrying direction of the continuous medium and is configured to detect a trailing edge of the continuous medium, the trailing edge being determined from the leading edge with a length specified by a user;

a cutting part that is arranged between the detection part and the trailing edge detection part, and is configured to selectively perform a cutting process to cut the continuous medium and a perforation process to form a line of perforations in the continuous medium, wherein a controller that is configured to communicate and control the detection part, the trailing edge detection part and the cutting part, assuming that a minimum length of the continuous medium that is carried by the carrying part is L2, a length from the detection part to the trailing edge detection part is L3, and a length of the continuous medium that is specified by the user is L4, if L4<L3<L2+L4 is satisfied as the trailing edge detection part detects the trailing edge of the continuous medium, the controller causes the detection part to detect a position that corresponds to L4 from the leading edge of the continuous medium, and the controller causes the cutting part to be actuated to perform the perforation process to form the line of perforations in the continuous medium at the position that is detected by the detection part and that corresponds to L4 from the leading edge of the continuous medium to prevent the continuous medium having a length less that L2 from being carried by the carrying part and to indicate the length of the continuous medium that is specified by the user.

2. The sheet feeding device according to claim 1, wherein when L4≥L3 is satisfied, the cutting part does not perform the cutting process or the perforation process, the carrying process is continued, and a host device, which is data-communication capably connected to the sheet feeding device, is notified of that the carried continuous medium has a length equal to or less than a requested sheet length.

3. The sheet feeding device according to claim 1, wherein the minimum length (L2) of the continuous medium that is carried by the carrying part is equal to a longest distance among distances between a plurality of carrying rollers arranged along a carrying path, the carrying path includes all paths along which the continuous medium is carried by the carrying part inside the sheet feeding device, and the carrying rollers are pairs of rollers that are arranged in a manner of sandwiching the carrying path.

4. A print device, comprising:

the sheet feeding device according to claim 1.

5. The print device according to claim 4, comprising a printing part that is arranged on a downstream side of the detection part in the carrying direction and performs printing on the continuous medium, wherein when the trailing edge detection part detects the trailing edge of the continuous medium, and when L4≤L3<L2+L4 is satisfied, which is the condition in which the cut piece having a length shorter than the length of L2 is generated by cutting the continuous medium into the length of L4, the detection part detects the position at which the length of the continuous medium from the leading edge is L4, and the printing part performs printing indicating a cutting position in the continuous medium at the position that is detected by the detection part and at which the length of the continuous medium from the leading edge is L4.

6. The print device according claim 5, wherein when print data transmitted to the printing part is configured with a plurality page units, the printing part prints pages that can be printed on the continuous medium that has a length of L3, and performs printing indicating the cutting position at a trailing edge of the printed pages.

* * * * *